US009713937B2

(12) United States Patent
Li

(10) Patent No.: US 9,713,937 B2
(45) Date of Patent: Jul. 25, 2017

(54) GLUE BOTTLE WITH FLOW REGULATION

(71) Applicants: HANGZHOU GREAT STAR TOOLS CO. LTD, Hangzhou (CN); HANGZHOU GREAT STAR INDUSTRIAL CO., LTD, Hangzhou (CN)

(72) Inventor: Yueming Li, Hangzhou (CN)

(73) Assignee: Hangzhou Great Star Industrial Co., Ltd., Hangzhou (CN)

( * ) Notice: Subject to any disclaimer, the term of this patent is extended or adjusted under 35 U.S.C. 154(b) by 211 days.

(21) Appl. No.: 14/369,906

(22) PCT Filed: Jan. 6, 2013

(86) PCT No.: PCT/CN2013/070118

§ 371 (c)(1),
(2) Date: Jan. 21, 2015

(87) PCT Pub. No.: WO2014/106337

PCT Pub. Date: Jul. 10, 2014

(65) Prior Publication Data

US 2015/0191040 A1 Jul. 9, 2015

(51) Int. Cl.
*B43M 11/06* (2006.01)
*B65D 47/24* (2006.01)
(Continued)

(52) U.S. Cl.
CPC ..... *B43M 11/06* (2013.01); *A46B 5/0095* (2013.01); *A46B 11/0058* (2013.01);
(Continued)

(58) Field of Classification Search
CPC combination set(s) only.
See application file for complete search history.

(56) References Cited

U.S. PATENT DOCUMENTS 2,669,740 A * 2/1954 Main ..... A46B 11/0013 215/228
3,216,630 A * 11/1965 Stull ..... B65D 47/242 222/499
(Continued)

FOREIGN PATENT DOCUMENTS

CN 2093819 U 1/1992
CN 2542597 4/2003
(Continued)

*Primary Examiner* — David Walczak
(74) *Attorney, Agent, or Firm* — Myron Greenspan; Lackenbach Siegel LLP

(57) ABSTRACT

A glue bottle with flow regulation comprises a bottle body, a bottle cap, and a liquid outlet cap engaged with the bottle cap through thread. The bottle cap is partially contained in the liquid outlet cap. A cavity is formed between the inner wall of the liquid outlet cap and the outer wall of the bottle cap. and is provided with a first opening and a second opening. A seal body is arranged on the top part of the bottle cap, and is positioned inside of the cavity. The position of the seal body in the cavity is adjusted by rotating the liquid outlet cap relative to the bottle cap. The closer the seal body is to the second opening, the smaller the gap is between the liquid outlet cap and the bottle cap. The glue bottle is capable of precisely controlling the quantity of the glue flowing out.

11 Claims, 2 Drawing Sheets

(51) Int. Cl.

| | |
|---|---|
| ***B65D 47/42*** | (2006.01) |
| ***B43M 11/02*** | (2006.01) |
| ***B65D 41/04*** | (2006.01) |
| ***B65D 47/20*** | (2006.01) |
| ***A46B 5/00*** | (2006.01) |
| ***A46B 11/00*** | (2006.01) |

(52) U.S. Cl.
CPC ..... *A46B 11/0079* (2013.01); *B43M 11/02* (2013.01); *B65D 41/04* (2013.01); *B65D 47/20* (2013.01); *B65D 47/242* (2013.01); *B65D 47/42* (2013.01)

(56) References Cited

U.S. PATENT DOCUMENTS 4,424,918 A * 1/1984 Stull ..... B65D 47/242 215/313
4,748,990 A 6/1988 Brown et al.
5,641,233 A * 6/1997 Wilson ..... A45D 34/042 401/277
5,857,796 A * 1/1999 Waldmann ..... A45D 34/041 401/205
5,871,128 A 2/1999 Carroll
6,662,973 B1 12/2003 Velliquette

FOREIGN PATENT DOCUMENTS

| | | | |
|---|---|---|---|
| CN | 2752076 | Y | 1/2006 |
| CN | 2885752 | Y | 4/2007 |
| CN | 200995835 | | 12/2007 |
| CN | 2118706 | | 9/2008 |
| CN | 201310005235.5 | | 9/2009 |
| CN | 201320005663.3 | | 9/2009 |
| CN | 202098659 | | 1/2012 |
| MX | 9703242 | | 3/1998 |

* cited by examiner

GLUE BOTTLE WITH FLOW REGULATION

FIELD OF THE INVENTION

The present invention relates to a glue bottle, and particularly to a glue bottle which is capable of regulating the flow.

DESCRIPTION OF THE PRIOR ART

The bottle body of glue bottles of prior art is mostly made of elastic material, and the opening of the bottle is mounted with a bottle cap having a small hole. The bottle body is pressed when in use, and the glue inside the bottle is pressed out through the small hole to be applied on desired places. However, when the glue bottle is in use, the situation that too much glue is pressed out by one press often occurs, and the superfluous glue causes much trouble to the user.

Thus a glue bottle of which the flow can be regulated has been developed. Such as a flow control valve has been disclosed in U.S. Pat. No. 6,662,973B1. The flow control valve can be used for glue bottle, thereby controlling the quantity of the glue flowing out from the opening of the bottle by each press. The flow control valve includes a sealing base, a sealing ball and a spring. The sealing base is provided with a central through hole arranged in the channel from the bottle body to the opening. The sealing ball is used for engaging with valve body and is positioned at the top part of the valve body. The spring is arranged between the sealing ball and the opening. When in use, the body of the glue bottle will be pressed. The glue in the bottle body would be pressed through the valve body against the sealing ball. The spring would be pressed. The sealing ball would separate from the top part of the valve body by the force of the glue. Thus the glue would leak through the flow aperture formed centrally therethrough of the valve body, and the glue would flow from the open end of the glue bottle for use. After the body of the glue bottle is ceased pressing, the glue in the bottle body would not be pressed. Thus the glue would not be against the sealing ball. The sealing ball would be reseated by the restoring force of the spring, sealing the flow aperture formed centrally therethrough again at the open end of the top part of the valve body. Since the stronger the squeeze on the bottle body is, the stronger the squeeze on the glue in the bottle body is, thus the pressure which glue make on sealing ball would be stronger. The shape change of the spring by the pressure against the spring would be greater. Then the distance between sealing ball and the top part of the valve body would be greater. The squeezed glue would leak through the flow aperture formed centrally therethrough of valve body, and the quantity of the glue which flows from the open end of the glue bottle would be greater. While the smaller the squeeze on the bottle body is, the smaller the squeeze on the glue in the bottle body is. Thus the pressure which glue make on sealing ball would be smaller. The shape change of the spring by the pressure against the spring would be smaller. Then the distance between sealing ball and the top part of the valve body would be shorter. The squeezed glue would leak through the flow aperture formed centrally therethrough of valve body, and the quantity of the glue which flows from the open end of the glue bottle would be smaller. As can be seen, the quantity of the glue which flows from the open end of the glue bottle which adopts the flow control valve of the above prior art by controlling the squeeze on the glue bottle.

However, it has been found that the glue bottle using the flow control valve of prior art is unstable in controlling the quantity of the glue flowing out through the opening thereof. As the users, especially the young and the old, cannot properly control the pressing force applied on the glue bottle, therefore, they cannot cause proper amount of glue to flow out through the opening.

Therefore, the person skilled in the art devotes to developing a glue bottle with flow regulation to realize convenient and precise control of the quantity of the glue flowing out through the opening of the glue bottle.

SUMMARY OF THE INVENTION

In view of the above defects of the prior art, the technical problem to be solved by the invention is to provide a glue bottle with flow regulation.

To realize the above purpose, the invention provides a glue bottle with flow regulation. The glue bottle includes a bottle body and a bottle cap engaging with the above bottle body. The glue bottle is characterized in that it also includes a liquid outlet cap engaging with the bottle cap through thread. The bottle cap is partially contained in the liquid outlet cap. A cavity is formed between the inner wall of the liquid outlet cap and the outer wall of the bottle cap. The cavity has a first opening and a second opening. The first opening is provided in the bottle cap. The second opening is provided in the liquid outlet cap. A seal body is arranged on the top part of bottle cap and is positioned in the cavity. The position of the seal body in the cavity is adjusted through rotating the outlet cap relative to the bottle cap. The closer the seal body is to the second opening, the smaller the gap is between the seal body and the inner wall of the liquid outlet cap.

Further, the seal body is cylindrical.

Further, the diameter of the seal body is greater than that of the second opening.

Further, the seal body is connected to the top part of the bottle cap through the support shafts.

Further, the number of the support shafts is three.

Further, the material of the seal body, the support shafts and the bottle cap are made of the same material.

Further, the seal body, the support shafts and the bottle cap are integrated.

Further, the bottle cap engages with the bottle body through thread.

Further, a first sealing ring is provided between the bottle cap and the bottle body. The first sealing ring causes sealing between the bottle cap and the bottle body.

Further, a second sealing ring is provided between the liquid outlet cap and the bottle cap. The second sealing ring causes sealing between the liquid outlet cap and the bottle cap.

Further, the diameter of the cross-section of the cavity at the first opening is greater than that at the second opening.

Further, the diameter of the cross-section of the cavity lessens gradually from the first opening to the second opening.

Optionally, a hairbrush is arranged on the top part of the liquid outlet cap.

Further, the hair brush surrounds the second opening. The glue in the bottle body flows from the first opening to the cavity, and the glue in the bottle body flows from the second opening to the hairbrush.

Optionally, a roller wheel is arranged on the top part of the liquid outlet cap.

Further, the edge of the roller wheel is above the second opening. The glue in the bottle body flows from the first opening to the cavity and flows out from the second opening to the edge of the roller wheel.

In an embodiment of the invention, a glue bottle with flow regulation having a hairbrush is provided, which includes a bottle body, a bottle cap and a liquid outlet cap. The bottle cap engages with the bottle body through thread therebetween, and a first sealing ring is provided therebetween to achieve sealing therebetween. The bottle cap engages with the liquid outlet cap through thread therebetween. The bottle cap is partially contained in the liquid outlet cap and a second sealing ring is provided therebetween to achieve sealing therebetween. A cavity is formed between the inner wall of the liquid outlet cap and the outer wall of the bottle cap. The cavity has a first opening and a second opening. The first opening is provided in the bottle cap. The second opening is provided in the liquid outlet cap. The diameter of the cross-section of the cavity lessens gradually from the first opening to the second opening. A cylindrical seal body is arranged on the top part of the bottle cap, and the diameter of the seal body is greater than that of the second opening. The seal body is positioned in the cavity and is connected to the top part of the bottle cap through three support shafts. The seal body, the support shafts and the bottle cap are integrated. A hairbrush is arranged on the top part of the liquid outlet cap, and the hairbrush surrounds the second opening. The position of the seal body in the cavity is adjusted in use through rotating the liquid outlet cap relative to the bottle cap. The closer the seal body is to the second opening, the smaller the gap is between the seal body and the inner wall of the liquid outlet cap. When the bottle body is pressed, the glue in the bottle body flows from the first opening to the cavity and flows out from the second opening to the hairbrush for use.

Another embodiment of the invention provides a glue bottle with flow regulation which has a roller wheel, including a bottle body, a bottle cap and a liquid outlet cap. The bottle cap engages with the bottle body through thread therebetween, and a first sealing ring is provided therebetween to achieve seal therebetween. The bottle cap engages with the liquid outlet cap through thread therebetween. The bottle cap is partially contained in the liquid outlet cap and a second sealing ring is provided therebetween to achieve seal therebetween. A cavity is formed between the inner wall of the liquid outlet cap and the outer wall of the bottle cap. The cavity has a first opening and a second opening. The first opening is provided in the bottle cap. The second opening is provided in the liquid outlet cap. The diameter of the cross-section of the cavity lessens gradually from the first opening to the second opening. A cylindrical seal body is arranged on the top part of the bottle cap, and the diameter of the seal body is greater than that of the second opening. The seal body positioned in the cavity is connected to the top part of the bottle cap through three support shafts. The seal body, the support shaft and the bottle cap are integrated. A roller wheel is arranged on the top part of the liquid outlet, and the edge of the roller wheel is above the second opening. The position of the seal body in the cavity is adjusted in use through rotating the liquid outlet cap relative to the bottle cap. The closer the seal body is to the second opening, the smaller the gap is between the seal body and the inner wall of the liquid outlet cap. When the bottle body is pressed, the glue in the bottle body flows from the first opening to the cavity and flows out from the second opening to the edge of the roller wheel for use.

It can be seen that the glue bottle with flow regulation of the invention realizes forming a cavity between the bottle cap and liquid outlet cap through arranging a liquid outlet cap on the bottle cap for engaging with bottle cap through thread, and a seal body which is connected to the bottle cap by support shafts at the first opening of the bottle cap. The position of the seal body in the cavity could be adjusted in use, when the liquid outlet cap rotating relative to the bottle cap. And then by adjusting the gap between the seal body and the inner wall of the liquid outlet cap, the quantity of the glue in the glue bottle with flow regulation of the invention flowing from gap can be controlled. Since the liquid outlet cap of the glue bottle with flow regulation of the invention rotating relative to the bottle cap, the gap between the seal body and the liquid outlet cap can be controlled accurately. Thus the glue bottle with flow regulation of the invention realizes controlling the quantity of the glue which flows from the glue bottle accurately. And the glue bottle with flow regulation of the invention has a simple structure, convenience of use and high practical value. The conception, concrete structure and technical effect of the invention will be illustrated further below to know the purpose, characteristic and effect adequately.

DETAILED DESCRIPTION OF THE PREFERRED EMBODIMENTS

Figure 1:
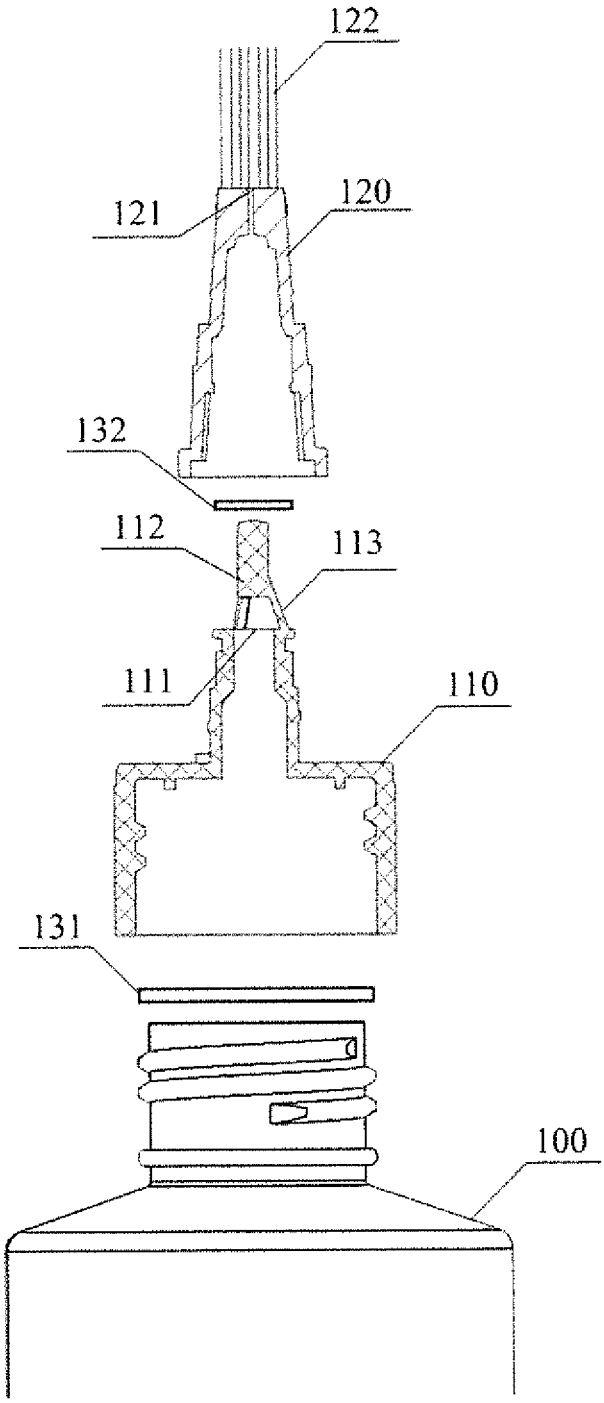
FIG. 1 is an exploded structural view of the glue bottle with flow regulation in the first embodiment of the present invention.

A glue bottle with flow regulation which has a hairbrush is provided in the first embodiment of the invention. The structural exploded view of the glue bottle is shown in FIG. 1, and it includes bottle body 100, bottle cap 110 and liquid outlet cap 120.

Bottle cap 110 and bottle body 100 are engaged through thread, and there is the first sealing ring therebetween to achieve seal therebetween. As shown in FIG. 1, in the embodiment, an external thread around the bottleneck of the bottle body 100, and an internal thread which engages with the external thread in the inner wall of the bottle cap 110. The bottle cap 110 is installed on the bottle body 100 with an internal thread engaging with the external thread. The first sealing ring 131 is installed on the bottleneck of the bottle body 100. After the bottle cap 110 engaging with bottle body 100 through thread, the first sealing ring 131 is fixed between the bottleneck of the bottle body 100 and the inner wall of the bottle cap 110, forming the seal between the bottle cap 110 and the bottle body 100.

The bottle cap 110 and the liquid outlet cap 120 are engaged through thread. The bottle cap 110 is partially contained in the liquid outlet cap 120, and there is the second sealing ring 132 forming the seal therebetween. As shown in FIG. 1, in the embodiment, an external thread around the upper bottle cap 110, and an internal thread which engages with the external thread around the inner wall of the liquid outlet cap 120. Through matching internal thread with external thread, the liquid outlet cap 120 is installed on the bottle cap 110, the upper bottle cap 110 is partially contained in the liquid outlet cap 120.

A first opening 111 is provided on the top part of the bottle cap 110. After the bottle cap 110 engaging with bottle body 100, the liquid in the bottle body 100 can flow from the bottle body 100 to the first opening 111. In the embodiment, the liquid contained in the bottle body 100 is glue.

A second opening 121 is provided on the top part of the liquid outlet cap 120, and the second sealing ring 132 is placed on the first opening 111. After the liquid outlet cap 120 engaging with the bottle cap 110 through thread, the second sealing ring 132 is fixed between the first opening 111 of the bottle cap 110 and the inner wall of the liquid outlet cap 120, forming the seal between the liquid outlet 120 and the bottle cap 110. In that way, the inner wall of the liquid outlet cap 120 and the outer wall of the bottle cap 110 form a cavity which has two opening which is first opening 111 and the second opening 121. The diameter of the cross-section of the cavity lessens gradually from the first opening 111 to the second opening 121, as can be realized by designing the inner wall of the liquid outlet cap 120.

After the engagement among the liquid outlet cap 120, the bottle cap 110 and the bottle body 100 is finished, the liquid in the bottle body 100 can flow from the bottle body 100 to the cavity through the first opening 111, then flow out of the cavity through the second opening.

A shaft seal body 112 is arranged on the top part of the bottle cap 110 (the top part of the first opening in FIG. 1), and the diameter of the seal body 112 is greater than that of the second opening 121. After the matching between the liquid outlet 120 and the bottle cap 110, the seal body 112 is positioned at the cavity, which is connected to the first opening 111 of the bottle cap 110 through three support shafts like support shaft 113. In the embodiment, the seal body 112, support shaft and bottle cap 110 are integrated, and they are made from the same material.

The hairbrush 122 is arranged on the top part of the liquid outlet cap 120 in the embodiment, and the hairbrush 122 surrounds the second opening 121.

When the glue bottle with flow regulation of the invention used, the liquid outlet cap 120 would be twisted to make the liquid outlet cap 120 rotate relative to the bottle cap 110. Thus the part of the bottle cap 110 that is positioned the liquid outlet cap 120, which is the size of the cavity, is changed to adjust the position of the seal body 112 in the cavity, and to adjust the size of the gap between the seal body 112 and the inner wall of the liquid outlet cap 120. For example, in the embodiment, when the liquid outlet cap 120 is screwed relative to the bottle cap 110 to the extreme position, the part of the bottle cap 110 is positioned within the liquid outlet cap 120 is maximum, and the cavity is minimum. The edge of the seal body 112 is against the inner wall of the liquid outlet cap 120 at the place of the second opening, the gap between the seal body 112 and the inner wall of the liquid outlet cap 120 is zero. After the bottle body 100 is squeezed, the liquid in the glue bottle 100 flows from the first opening 111 of the bottle body 100 to the cavity, but it is incapable of flowing from the second opening 121. When the liquid outlet cap 120 is unscrewed relative to the bottle cap 110 for a part, such as being unscrewed for 0.5 mm, the part of the bottle cap 110 inside the liquid outlet cap 120 reduces by 0.5 mm along the axial direction of the glue bottle of the invention, and the cavity increases by 0.5 mm along that axial direction. The edge of the seal body 112 leaves the inner wall of the liquid outlet cap 120 at the second opening, the gap between the seal body 112 and the inner wall of the liquid outlet cap 120 is not zero. After the bottle body 100 is squeezed, the liquid in the bottle body 100 flows from the bottle body 100 to the cavity through the first opening 111, and the liquid can flow from the second opening 121 to the hairbrush 122 to be used. When the liquid outlet cap 120 is unscrewed relative to the bottle cap 110 for a part again, such as being unscrewed for 0.5 mm more, the part of the bottle cap 110 inside of the liquid outlet cap 120 reduces by 0.5 mm more along the axial direction of the glue bottle of the invention, and the cavity increases by 0.5 mm more along that axial direction. The edge of the seal body 112 leaves the inner wall of the liquid outlet cap 120 at the second opening 121, the gap between the seal body 112 and the inner wall of the liquid outlet cap 120 becomes larger. After the bottle body 100 is squeezed, more liquid in the bottle body 100 would flow from the bottle body 100 to the cavity through the first opening 111, and the liquid can flow from the second opening 121 to the hairbrush 122 to be used.

Figure 2:
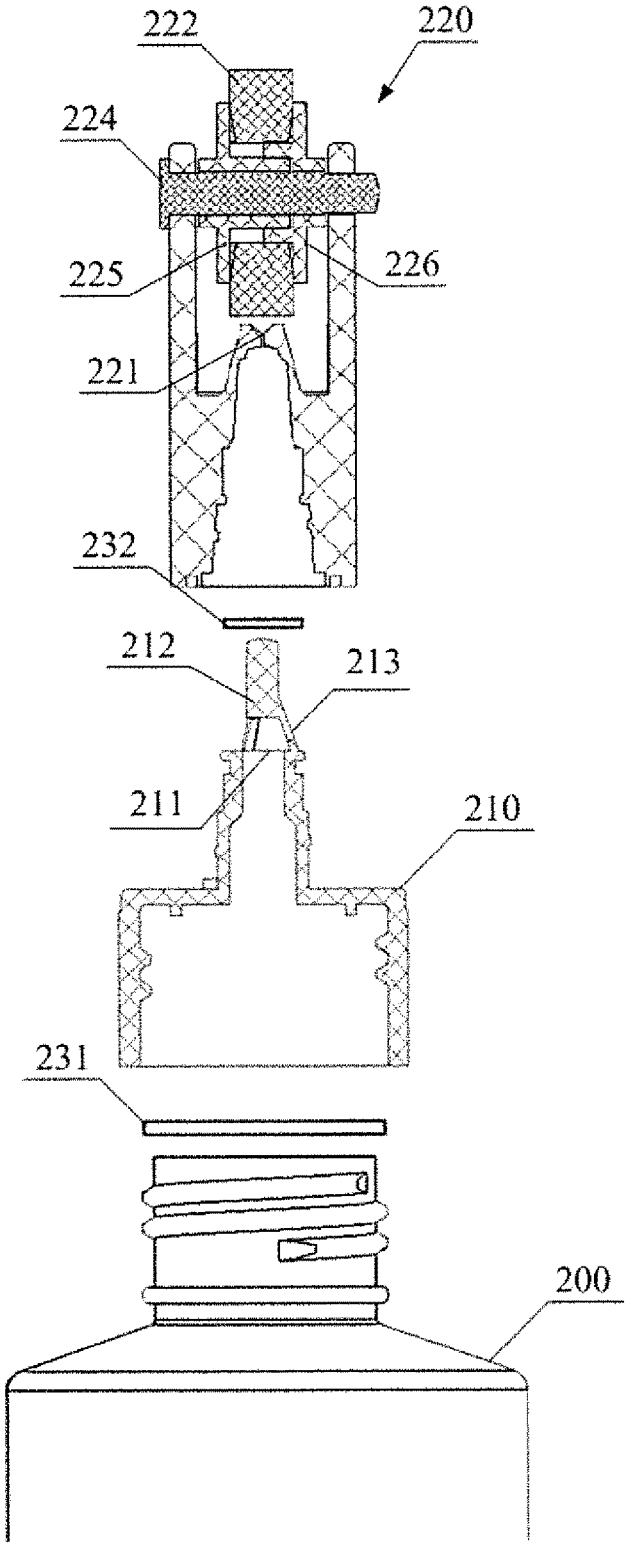
FIG. 2 is an exploded structural view of the glue bottle with flow regulation in the second embodiment of the present invention.

A glue bottle with flow regulation which has a roller wheel is provided in the second embodiment of the invention. The structural exploded view of the glue bottle is shown in FIG. 2, and it includes a bottle body 200, a bottle cap 210 and a liquid outlet cap 220.

The bottle cap 210 and the bottle body 200 engages through thread, and a first sealing ring is provided therebetween to achieve seal therebetween. As shown in FIG. 2, in the embodiment, an external thread is provided around the bottleneck of the bottle body 200, and an internal thread which engages with the external thread is provided in the inner wall of the bottle cap 210. The bottle cap 210 is installed on the bottle body 200 with the internal thread engaging with the external thread. The first sealing ring 231 is installed on the bottleneck of the bottle body 200. After the bottle cap 210 engages with bottle body 200 through thread, the first sealing ring 231 is fixed between the bottleneck of the bottle body 200 and the inner wall of the bottle cap 210, forming the seal between the bottle cap 210 and the bottle body 100.

The bottle cap 210 and the liquid outlet cap 220 are engaged through thread. The bottle cap 210 is partially contained in the liquid outlet cap 220, and the second sealing ring 232 forming the seal is provided therebetween. As shown in FIG. 2, in the embodiment, an external thread is provided around the upper bottle cap 210, and an internal thread which engages with the external thread is provided around the inner wall of the liquid outlet cap 220. Through engaging internal thread with external thread, the liquid outlet cap 220 is installed on the bottle cap 210, the upper part of the bottle cap 210 is partially contained in the liquid outlet cap 220.

A first opening 211 is provided on the top part of the bottle cap 210. After the bottle cap 210 engages with bottle body 200, the liquid in the bottle body 200 can flow from the bottle body 200 to the first opening 211. In the embodiment, the liquid contained in the bottle body 200 is glue.

A second opening 221 is provided on the top part of the liquid outlet cap 220, and the second sealing ring 232 is arranged on the first opening 211. After the liquid outlet cap 220 engages with the bottle cap 210 through thread, the second sealing ring 232 is fixed between the first opening 211 of the bottle cap 210 and the inner wall of the liquid outlet cap 220, forming the seal between the liquid outlet 220 and the bottle cap 210. In that way, a cavity is formed between the inner wall of the liquid outlet cap 220 and the outer wall of the bottle cap 210, and the cavity has two opening which are a first opening 211 and a second opening 221. The diameter of the cross-section of the cavity lessens gradually from the first opening 211 to the second opening 221, as can be realized by designing the inner wall of the liquid outlet cap 220.

After the engagement among the liquid outlet cap 220, the bottle cap 210 and the bottle body 200 is finished, the liquid in the bottle body 200 can flow from the bottle body 200 to the cavity through the first opening 211, then flow out of the cavity through the second opening.

A shaft seal body 212 on the top part of the bottle cap 210 (the top part of the first opening in FIG. 2), and the diameter of the seal body 212 is greater than that of the second opening 221. After the liquid outlet 220 and the bottle cap 210 are engaged, the seal body 212 is positioned at the cavity, which is connected to the first opening 211 of the bottle cap 210 through three support shafts such as support shaft 213. In the embodiment, the seal body 212, the support shaft and bottle cap 210 are integrated, and they are made from the same material.

In the embodiment, the roller wheel 222 is arranged on the top part of the liquid outlet cap 220, and the edge of the roller wheel 222 is on the top part of the second opening 221. The roller wheel 222 in the embodiment is arranged on the liquid outlet cap 200 via a bolt 224 which is fixed on the top part of the liquid outlet 220. Moreover, two pressing plates, which are the left pressing plate 225 and the right pressing plate 226, are clamped onto both sides of the roller wheel 222 to limit the movement of the roller wheel along the direction of the bolt 224, which makes the roller wheel 222 only rotate around the bolt 224.

When using the glue bottle with flow regulation of the invention, the liquid outlet cap 220 would be twisted to make the liquid outlet cap 220 rotate relative to the bottle cap 210. Thus the part of the bottle cap 210 is positioned the liquid outlet cap 220, which is the size of the cavity, is changed, to adjust the position of the seal body 212 in the cavity, and to adjust the size of the gap between the seal body 212 and the inner wall of the liquid outlet cap 220. For example, in the embodiment, when the liquid outlet cap 220 is screwed relative to the bottle cap 210 to the extreme position, the part of the bottle cap 210 that is positioned the liquid outlet cap 220 is maximum, and the cavity is minimum. The edge of the seal body 212 is against the inner wall of the liquid outlet cap 220 at the place of the second opening, thus the gap between the seal body 212 and the inner wall of the liquid outlet cap 220 is zero. After the bottle body 200 is squeezed, the liquid in the glue bottle 200 flows from the first opening 211 of the bottle body 200 to the cavity, but it is incapable of flowing out of the second opening 221. When the liquid outlet cap 220 is unscrewed relative to the bottle cap 210 for a part, such as being unscrewed for 0.5 mm, the part of the bottle cap 210 inside of the liquid outlet cap 220 reduces by 0.5 mm along the axial direction of the glue bottle of the invention, and the cavity increases by 0.5 mm along that axial direction. The edge of the seal body 212 leaves the inner wall of the liquid outlet cap 220 at the second opening, the gap between the seal body 212 and the inner wall of the liquid outlet cap 220 is not zero. After the bottle body 200 is squeezed, the liquid in the bottle body 200 flows from the bottle body 200 to the cavity through the first opening 211, and the liquid could flow out of the second opening 221 to the roller wheel 222 to be used. When the liquid outlet cap 220 is unscrewed relative to the bottle cap 210 for a part again, such as being unscrewed for 0.5 mm more, the part of the bottle cap 210 inside of the liquid outlet cap 220 reduces by 0.5 mm more along the axial direction of the glue bottle of the invention, and the cavity increases by 0.5 mm more along that axial direction. The edge of the seal body 212 leaving the inner wall of the liquid outlet cap 220 at the second opening, the gap between the seal body 212 and the inner wall of the liquid outlet cap 220 becomes larger. After the bottle body 200 is squeezed, more liquid in the bottle body 200 would flow from the bottle body 200 to the cavity through the first opening 211, and the liquid could flow out of the second opening 221 to the roller wheel 222 to be used.

The invention has been exemplified above with reference to specific embodiments. However, it should be understood that a multitude of modifications and varieties can be made by a common person skilled in the art based on the conception of the present invention. Therefore, any technical schemes, acquired by the person skilled in the art based on the conception of the present invention through logical analyses, deductions or limited experiments, fall within the scope of the invention as specified in the claims.

The invention claimed is:

1. A glue bottle with flow regulation comprising a bottle body and a bottle cap threadedly engaged with the bottle body, wherein the glue bottle further comprises a liquid outlet cap threadedly engaged with the bottle cap, the bottle cap being partially received within the liquid outlet cap forming a cavity between an inner wall of the liquid outlet cap and an outer wall of the bottle cap, the cavity is provided with a first opening and a second opening, the first opening is in the bottle cap, the second opening is in the liquid outlet cap, a seal body is arranged on top part of the bottle cap and positioned in the cavity, and the position of the seal body in the cavity is adjusted through rotating the liquid outlet cap relative to the bottle cap, the closer the seal body is to the second opening, the smaller a gap is between the seal body and the inner wall of the liquid outlet cap, the diameter of the seal body is greater than that of the second opening such that the seal body cannot protrude through the second opening; the liquid outlet cap is integrated; wherein a hairbrush is arranged on a top part of the liquid outlet cap and the hair brush surrounds the second opening, the first opening is adapted to allow glue in the bottle body flow to the cavity and the second opening is adapted to allow glue flow directly to the hairbrush.

2. The glue bottle with flow regulation according to claim 1, wherein the seal body is cylindrical.

3. The glue bottle with flow regulation according to claim 1, wherein the seal body is connected to the top part of the bottle cap through support shafts.

4. The glue bottle with flow regulation according to claim 3, wherein the number of the support shafts is three.

5. The glue bottle with flow regulation according to claim 3, wherein the seal body, the support shafts and the bottle cap are made of the same material.

6. The glue bottle with flow regulation according to claim 5, wherein the seal body, the support shafts and the bottle cap are integrated.

7. The glue bottle with flow regulation according to claim 1, wherein the bottle cap engages with the bottle body through thread.

8. The glue bottle with flow regulation according to claim 7, wherein a first sealing ring is provided between the bottle cap and the bottle body, and the first sealing ring causes sealing between the bottle cap and the bottle body.

9. The glue bottle with flow regulation according to claim 8, wherein a second sealing ring is provided between the liquid outlet cap and the bottle cap, and the second sealing ring causes sealing between the liquid outlet cap and the bottle cap.

10. The glue bottle with flow regulation according to claim 1, wherein the diameter of the cross-section of the cavity at the first opening is greater than that at the second opening.

11. The glue bottle with flow regulation according to claim 10, wherein the diameter of the cross-section of the cavity lessens gradually from the first opening to the second opening.

* * * * *